United States Patent [19]

Richardson, Jr.

[11] 4,313,715

[45] Feb. 2, 1982

[54] ANTI-SLUG SUCTION MUFFLER FOR HERMETIC REFRIGERATION COMPRESSOR

[75] Inventor: Hubert Richardson, Jr., Brooklyn, Mich.

[73] Assignee: Tecumseh Products Company, Tecumseh, Mich.

[21] Appl. No.: 106,287

[22] Filed: Dec. 21, 1979

[51] Int. Cl.[3] ..... F04B 39/16

[52] U.S. Cl. ..... 417/312; 55/276; 55/385 R; 55/458; 417/902

[58] Field of Search ..... 417/312, 313, 902, 415; 55/458, 459 B, 461, 276, 385 R; 92/79

[56] References Cited

U.S. PATENT DOCUMENTS

| | | | |
|---|---|---|---|
| 971,823 | 10/1910 | Bishop | 55/461 |
| 2,133,875 | 10/1938 | Steenstrup . | |
| 2,501,794 | 3/1950 | Stephens | 417/312 |
| 3,084,523 | 4/1963 | Bottum et al. . | |
| 3,180,567 | 4/1965 | Quiggle et al. . | |
| 3,387,774 | 6/1968 | Gannaway et al. . | |
| 3,514,225 | 5/1970 | Monden et al. | 417/902 X |
| 3,563,053 | 2/1971 | Bottum . | |
| 4,105,374 | 8/1978 | Scharf . | |
| 4,147,479 | 4/1979 | Morse . | |

*Primary Examiner*—William L. Freeh
*Assistant Examiner*—Edward Look
*Attorney, Agent, or Firm*—Albert L. Jeffers; John F. Hoffman

[57] ABSTRACT

A hermetic refrigeration motor-compressor assembly includes a motor driving a compressor having suction and discharge ports. A hermetically sealed casing encloses the motor and compressor and has a gas inlet opening coupled by a conduit to the evaporator of the refrigeration system. A discharge conduit is coupled to the compressor discharge port and extends out of the casing to the condenser. The casing also encloses a suction muffler having a wall defining a chamber, the wall having inlet and outlet openings communicating with the chamber, the casing and muffler inlet openings being in closely spaced alignment to provide a semi-direct suction coupling. The muffler outlet opening is directly coupled to the compressor suction port. The wall of the muffler has another opening therein spaced from the inlet and outlet openings and communicating with the chamber. A passage in the muffler chamber extends between the inlet and other opening and has opposite ends respectively coupled thereto. The passage has a vent opening therein communicating with the chamber so that gas entering the passage through the muffler inlet opening flows outwardly through the vent opening into the chamber and then through the outlet opening to the compressor suction port whereas, a slug of liquid refrigerant flows through the passage and out of the other opening to the sump in the casing.

10 Claims, 4 Drawing Figures

ANTI-SLUG SUCTION MUFFLER FOR HERMETIC REFRIGERATION COMPRESSOR

BACKGROUND OF THE INVENTION

1. Description of the Prior Art

Hermetic refrigeration motor-compressor units conventionally include a motor driving a compressor having suction and discharge ports. A hermetically sealed casing encloses the motor and compressor and has a gas inlet opening adapted to be coupled by a conduit to the evaporator of the refrigeration system, and a discharge conduit is coupled to the compressor discharge port and extends out of the casing to the condenser of the refrigeration system. In order to achieve noise reduction, it is known to provide a suction muffler in the casing, such a muffler being shown in U.S. Pat. No. 2,133,875 and in U.S. Pat. No. 3,610,784 assigned to the assignee of the present application. It is also known to position the inlet opening of the suction muffler in spaced alignment with the inlet opening of the casing to provide a sem-direct suction coupling.

A slugging problem has been encountered in prior semi-direct suction muffler systems, i.e., under certain conditions, particularly in the case of an airconditioning system in which the compressor and evaporator are located out-of-doors, a slug of liquid refrigerant may be drawn into the suction muffler and thence into the compressor which may cause an excessive overpressure condition capable of rupturing gaskets, breaking valves, or altering the bearing alignment of the compressor.

Various slug-inhibiting arrangements have been employed in refrigeration systems including accumulators external to the compressor casing, as shown for example in U.S. Pat. Nos. 3,084,523, 3,180,567 and 3,563,053, and U.S. Pat. No. 3,387,774 discloses a slug-inhibiting system wherein a liquid refrigerant slug is rejected by the fan formed on the end ring of a compressor drive motor.

It is desirable to provide a hermetic refrigeration motor-compressor assembly including a suction muffler within the hermetically sealed compressor casing with semi-direct suction and including means for inhibiting slugs of liquid refrigerant from entering the compressor, the system also providing minimum heat-transfer to the cool gas entering the compressor thereby improving the efficiency of the refrigeration apparatus.

SUMMARY OF THE INVENTION

The invention is embodied in a hermetic refrigeration motor-compressor assembly which includes a motor driving a compressor having suction and discharge ports with a hermetically sealed casing enclosing the motor and compressor and having a gas inlet opening and sump therein, a discharge conduit being coupled to the compressor discharge port and extending out of the casing. The casing encloses a suction muffler having a wall defining a chamber, the wall having inlet and outlet openings therein communicating with the chamber with the casing and muffler inlet openings being in closely spaced alignment to provide a semi-direct suction coupling and with the muffler outlet opening being directly coupled to the compressor suction port. In accordance with the broader aspects of the invention, the muffler wall has another opening therein spaced from the inlet and outlet openings and communicating with the chamber, and a passage is provided in the muffler chamber extending between the inlet and other openings and having opposite ends respectively coupled thereto. The passage has a vent opening therein communicating with the muffler chamber so that gas entering the passage through the muffler inlet opening flows through the passage and outwardly through the vent opening into the chamber and vents through the outlet opening to the compressor suction port whereas, a slug of liquid refrigerant flows through the passage and out of the other opening to the casing sump.

it is accordingly an object of the invention to provide a hermetic refrigeration motor-compressor assembly including a suction muffler having slug-inhibiting means therein.

Another object of the invention is to provide a hermetic refrigeration motor-compressor assembly including a suction muffler in the hermetic compressor casing having a semi-direct suction coupling and having slug-inhibiting means therein, the suction muffler being disposed with respect to the compressor to permit minimum heat transfer to the cool refrigerant gas entering the compressor.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
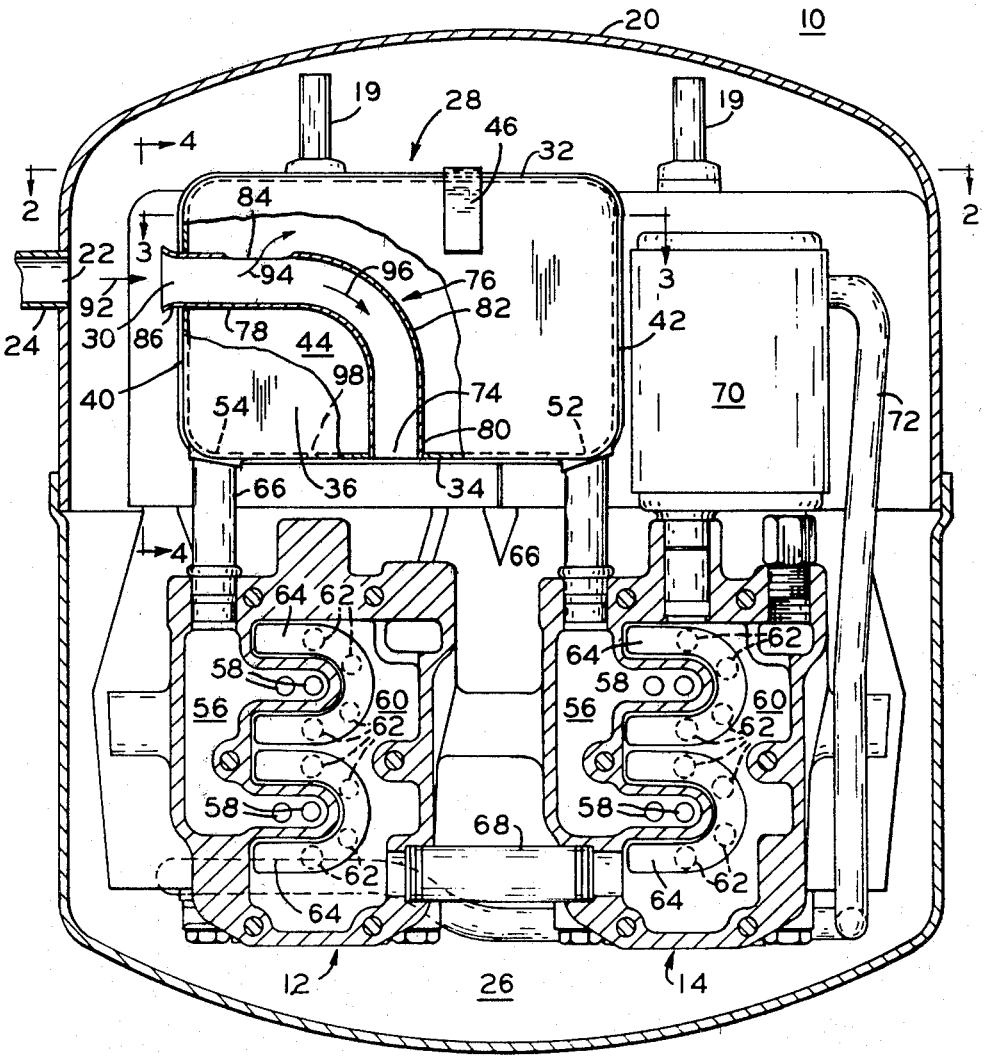
FIG. 1 is a cross sectional view, partly broken away, of a dual hermetic motor-compressor assembly incorporating the improved slug-inhibiting suction muffler of the invention.
Figure 2:
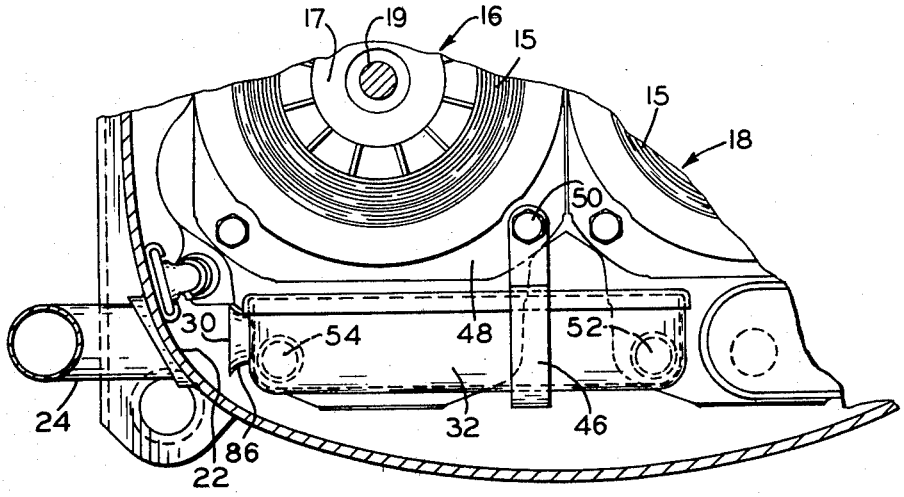
FIG. 2 is a fragmentary, cross-sectional view taken generally along the line 2—2 of FIG. 1.
Figure 3:
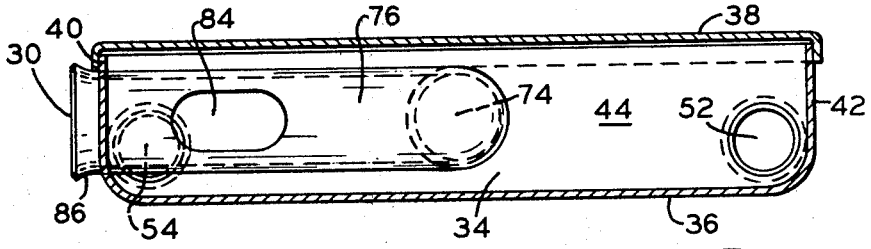
FIG. 3 is a fragmentary, cross-sectional view of the improved slug-inhibiting muffler of the invention taken generally along the line 3—3 of FIG. 1.
Figure 4:
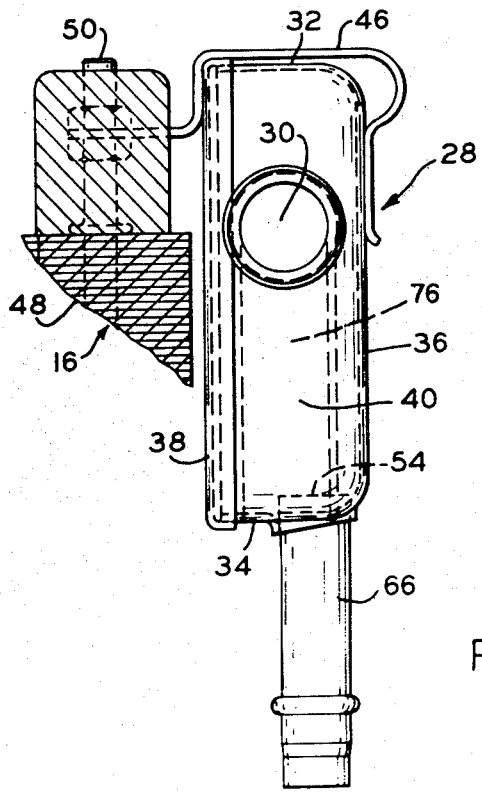
FIG. 4 is a fragmentary, cross-sectional view taken generally along the line 4—4 of FIG. 1.

Referring now to FIG. 1 of the drawings, there is shown a hermetic refrigeration motor-compressor assembly, generally indicated at 10. In a specific embodiment shown, motor-compressor assembly 10 includes a dual motor-compressor unit, i.e., two compressors 12, 14 respectively driven by conventional motors 16, 18 (FIG. 2). Motors 16, 18 have conventional windings 15 and rotors 17 mounted on shafts 19 which drive compressors 12, 14 in conventional fashion. Hermetically sealed casing 20 encloses compressors 12, 14 and driving motors 16, 18. Casing 20 has gas inlet opening 22 formed therein adapted to be coupled to the evaporator of the refrigeration system (not shown) by conduit 24. Sump 26 is formed in the lower region of casing 20 below compressors 12, 14.

Hermetic casing 20 also encloses suction muffler 28 closely spaced above compressors 12, 14. Suction muffler 28 has inlet opening 30 in closely spaced alignment with gas inlet opening 22 in casing 20 to provide semi-direct suction.

Suction muffler 28 has opposite to and bottom walls 32, 34, side walls 36, 38, and end walls 40, 42 mutually defining muffler chamber 44. Clip 46 secures muffler 28 to stator core 48 of motor 16 by means of shoulder bolt 50 which secures stator core 48 to the crankcase. Inlet opening 30 of muffler 28 is formed in end wall 40 and spaced outlet openings 52, 54 are formed in bottom wall 34.

Compressors 12, 14, shown in FIG. 1 with the heads in cross section are conventional, each including two cylinders and pistons (not shown). Each of the compressors 12, 14 include suction passage 56 communicating with suction ports 58, and discharge passages 60 communicating with discharge ports 62. Conventional discharge valves 64 cooperate with discharge port 62. The construction of compressors 12, 14, is conventional and need not further be described.

Suction muffler 28 is disposed in close proximity to compressors 12, 14 and outlet openings 52, 54 therein are respectively coupled to suction passages 56 by relatively short conduits 66. Discharge passages 60 of compressors 12, 14 are connected by conduit 68, and discharge passage 60 of compressor 14 is coupled to exhaust muffler 70. Discharge conduit 72 is coupled to exhaust conduit 70, extends out of casing 20 and is adapted to be coupled to the condenser of the refrigeration system (not shown) in conventional fashion. It will be seen that compressors 12, 14, respectively driven by motors 16, 18, are coupled in parallel. While dual, two-cylinder compressors 12, 14 are shown, it will readily be understood that the invention is equally applicable to a hermetic refrigeration motor-compressor assembly utilizing a single compressor having any desired number of cylinders.

In accordance with the invention, another opening 74 is formed in bottom wall 34 of suction muffler 28 intermediate outlet openings 52, 54, and conduit 76 extends between inlet opening 30 and outlet opening 74 and has its opposite ends respectively secured to end wall 40 and bottom wall 34. Conduit 76 has straight section 78 extending from inlet opening 30 generally parallel with top and bottom walls 32, 34, and straight section 80 extending from opening 74 generally parallel with end walls 40, 42, sections 78, 80 being joined by curved section 82. Vent opening 84 is formed in straight section 78 of conduit 76 facing top wall 32 and communicating with chamber 44. Conduit 76 has flared end 86 extending out of inlet opening 30 toward inlet opening 22 in casing 20 and axially aligned therewith.

It will now be seen that refrigerant gas from the evaporator of the refrigeration system (not shown) entering casing 20 through inlet opening 22, as shown by arrow 92, enters inlet opening 30 of conduit 76 and then flows outwardly through vent opening 84 into chamber 44, as shown by arrow 94, then flowing through outlet openings 52, 54, conduits 66 and into suction passages 56 and suction ports 58 of compressors 12, 14. It will be seen that the location of suction muffler 28 in close proximity to suction passages 56 of compressors 12, 14 and its coupling thereto by the relatively short suction conduits 66 provides a relatively short path for the cool refrigerant gas from the evaporator thus minimizing heat transfer to the gas from compressors 12, 14 and motors 16, 18, thereby improving the efficiency of the system.

In the event that a slug of liquid refrigerant from suction conduit 24 enters casing 20 through inlet opening 22 and inlet opening 30 of conduit 76, the inertia of that slug of liquid refrigerant by reason of its greater mass will cause it to flow through conduit 76, as shown by arrow 96 and through opening 74 in bottom wall 34 of suction muffler 28, the liquid refrigerant slug thus being discharged onto compressors 12, 14, and eventually reaching sump 26. Drain opening 98 is formed in bottom wall 34 of suction muffler 28 in order to drain any liquid refrigerant which may be entrained in or condensed from the refrigerant gas entering chamber 44.

While the slug-inhibiting feature of suction muffler 28 is shown as comprising curved conduit 76 communicating with inlet opening 30 in end wall 40 and opening 74 in bottom wall 34, it will be readily understood that the slug-intercepting passage in suction muffler 28 may have other forms and configurations so long as it is arranged so that the interia of the slug of liquid refrigerant carries it through the passage while the lighter refrigerant gas escapes through a vent opening in the passage into the muffler chamber 44.

It will be seen that the suction muffler of the invention is constructed and arranged so as to deliver cool return gas directly to the compressor cylinders with minimum heat-transfer while separating any liquid refrigerant from the gas and discharging the same onto the warm exterior parts of the compressor so that no liquid refrigerant is drawn into the compressor cylinders.

While there have been described above the principles of this invention in connection with specific apparatus, it is to be clearly understood that this description is made only by way of example and not as a limitation to the scope of the invention.

What is claimed is:

1. In a hermetic refrigeration motor-compressor assembly including a motor driving a compressor having suction and discharge ports, a hermetically sealed casing enclosing said motor and compressor and having a gas inlet opening and a sump therein, a discharge conduit coupled to said compressor discharge port and extending out of said casing, and a suction muffler in said casing having a wall defining a chamber, said wall having inlet and outlet openings therein communicating with said chamber, said casing and muffler inlet openings being in closely-spaced alignment thereby to provide semi-direct suction, said muffler outlet opening being directly coupled to said compressor suction port: the improvement wherein said muffler wall has another opening therein spaced from said inlet and outlet openings and communicating with said chamber, and comprising a passage in said muffler chamber extending between said inlet and said another openings and having opposite ends respectively coupled thereto, said passage having a vent opening therein communicating with said chamber, whereby gas entering said passage through said muffler inlet opening flows through said vent opening into said chamber and thence through said outlet opening to said compressor suction port whereas, a slug of liquid refrigerant flows through said passage and out of said another opening to said sump.

2. The assembly of claim 1 wherein said muffler is closely adjacent said compressor suction port.

3. The assembly of claim 1, or claim 2 wherein said muffler wall has a plurality of sections, said muffler inlet and outlet openings being respectively formed in first and second ones of said wall sections, said another opening being formed in a wall section other than said first wall section.

4. The assembly of claim 3 wherein said another opening is in said second wall section.

5. The assembly of claim 3 wherein said muffler wall sections comprise opposite top and bottom sections and opposite end sections, said muffler inlet opening being formed in a said end wall section and said outlet opening being formed in said bottom wall section.

6. The assembly of claim 5 wherein said passage is a conduit and said vent opening is formed in the wall thereof facing said top wall section.

7. The assembly of claim 6 wherein said another opening is formed in said muffler bottom wall section spaced from said outlet opening.

8. The assembly of claim 7 wherein said conduit has a first section coupled to said muffler inlet opening and generally parallel with said top wall section and a second section coupled to said another opening and generally parallel with said side wall sections, said first and second conduit sections being joined by a curved section, said vent opening being formed in said first conduit section.

9. The assembly of claim 8 wherein said bottom wall section is closely spaced from said compressor, whereby said liquid refrigerant flows from said another opening over said compressor to said sump.

10. The assembly of claim 9 wherein said suction muffler is secured to said motor.

* * * * *